United States Patent [19]

Gess

[11] 4,244,159

[45] Jan. 13, 1981

[54] MACHINE FOR PRODUCING PACKAGES SEQUENTIALLY FROM CONTINUOUS FLEXIBLE TUBING

[76] Inventor: Larry C. Gess, 9270 Secor Rd., Temperance, Mich. 48182

[21] Appl. No.: 24,965

[22] Filed: Mar. 29, 1979

[51] Int. Cl.[3] ..... B65B 9/00; B65B 5/02; B65B 9/12

[52] U.S. Cl. ..... 53/567; 53/570; 53/386

[58] Field of Search ..... 53/457, 459, 469, 452, 53/481, 547, 552, 384, 385, 386, 567, 548

[56] References Cited

U.S. PATENT DOCUMENTS

| | | | |
|---|---|---|---|
| 2,847,806 | 8/1958 | Wang | 53/459 |
| 3,070,927 | 1/1963 | Lundahl | 53/548 X |
| 3,264,794 | 8/1966 | Brown et al. | 53/459 |
| 3,543,466 | 12/1970 | Forsberg | 53/459 |
| 3,792,565 | 2/1974 | Goransson | 53/567 |
| 3,908,335 | 9/1975 | Giannelli | 53/567 X |
| 3,948,019 | 4/1976 | Döring et al. | 53/385 X |
| 4,094,125 | 6/1978 | Gess | 53/384 X |

*Primary Examiner*—Horace M. Culver
*Attorney, Agent, or Firm*—Allen D. Gutchess, Jr.

[57] ABSTRACT

A packaging machine for packaging articles is provided. The packaging machine employs a source of packaging material in the form of a length of plain plastic tubing. The machine is relatively simple and maintenance free, employing but one station. In a previous cycle, the tubing is heat sealed along a strip extending transversely thereof at a leading edge. The strip is then advanced a predetermined distance between a movable jaw and a stationary jaw at the station and the movable jaw closes against the stationary one. At this time, an upper sealing wire is energized to seal a leading edge of the tubing which will form the next package. A knife severs the tubing below that seal and the upper edges of the severed section are engaged by clamps. The movable jaw then opens to enable an article to be dropped in the resulting pocket in the severed section. The movable jaw closes once again and a lower sealing wire seals the upper edges of the severed section, below the severed edges thereof. The jaws then open a second time and the clamps are released so that the resulting package with the packaged article is discharged from the machine. Before the tubing is advanced again, it is slightly retracted to separate the leading edge from the upper sealing wire if it has had a tendency to stick thereto.

5 Claims, 5 Drawing Figures

MACHINE FOR PRODUCING PACKAGES SEQUENTIALLY FROM CONTINUOUS FLEXIBLE TUBING

This invention relates to a single-station machine for packaging articles or products.

The new machine according to the invention utilizes packaging material in the form of plain, plastic tubing. This tubing has no preformed seals, slits, or special shapes and, therefore, constitutes a low-cost source of packaging material, as compared to the special tubing required for many commercially-available machines.

The packaging machine disclosed in my U.S. Pat. No. 4,094,125 also utilizes plain, plastic tubing as the source of packaging material. That machine employs two separate stations, side-by-side, with operations being performed by both stations simultaneously. The packaging machine according to the instant invention performs all of the packaging operations at one station. It has been discovered that a high production rate can be achieved even though all operations are at the one station. Further, with but one station, the packaging machine is lower in cost and requires less maintenance.

The single-station of the packaging machine employs two engageable members or jaws, preferably one of which is fixed and the other of which is movable toward and away from the fixed one. One of the jaws has upper and lower sealing wires with the other jaw having backup strips at the same positions. A movable knife is carried by one of the jaws between the wires or backup strips which knife moves across the tubing in a direction parallel to the sealing wires or strips to sever the tubing. Each jaw also has clamping means below the knife for engaging upper severed edges of a severed packaged section, which open the section to enable a pocket formed thereby to receive an article when the jaws are moved apart.

In the operations of the packaging machine, the leading edge of the tubing projects into the space between the tops of the jaws with its leading edge transversely sealed during a previous cycle. The tubing is then advanced downwardly between the jaws a predetermined distance. The movable jaw then closes against the stationary one and the top sealing wire is energized to seal what will be the leading edge of the tubing for the next package. The knife carried by one of the jaws then moves transversely across the package, severing the tubing below the last sealed strip, and forming a lower severed package section. Clamping means of the jaws then engage the upper severed edges of the severed section. The movable jaw then moves back to open the severed edges so that an article to be packaged can be dropped into the pocket formed by the severed section. The movable jaw then moves against the stationary jaw again, at which time the lower sealing of the wire is energized to seal the top of the severed package section below the severed edges. The jaw then opens a second time, at which time the clamps are released and the newly-formed package is discharged from the packaging machine. At that time the knife resets to its original position before the tubing is advanced. The tubing is retracted slightly to free the leading edge from the upper seal of the jaws in the event it had a tendency to adhere thereto. The tubing is then advanced the predetermined distance again to start to form another package.

Even though the jaws must open and close twice to form each package, the machine nevertheless achieves a high production rate and is of relatively simple design, as compared to a two-station machine.

It is, therefore, a principal object of the invention to provide a single-station packaging machine which forms packages at a high rate of production.

Another object of the invention is to provide a packaging machine for forming packaging from plain tubing which is of simpler design and lower in cost.

A further object of the invention is to provide a single-station packaging machine which forms packages from plain tubing and is relatively maintenance free.

Many other objects and advantages of the invention will be apparent from the following detailed description of a preferred embodiment thereof, reference being made to the accompanying drawings, in which.

Figure 1:
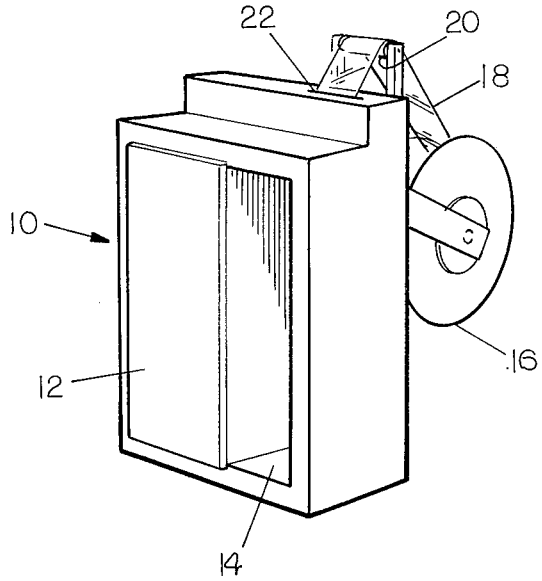
FIG. 1 is a schematic view in perspective of an overall single-station packaging machine in accordance with the invention.

Referring to FIG. 1, an overall single-station packaging machine is indicated at 10. The machine includes a control cabinet 12 and a recess 14 into which discharged, filled packages drop. A receptacle or an end of a conveyor can be located in the recess 14, by way of example, to receive the packages. A spool 16 is rotatably supported on the back of the machine and holds a supply of plain flexible tubing 18 which is directed over a suitable guide roll 20 and moves into an opening 22 at the top of the machine. The tubing can have a thickness from 1-$\frac{1}{2}$ to four mils, by way of example.

The tubing 18 is advanced by rubber covered rolls 24 (FIGS. 2–4) and backup rolls 26, all of which are driven by means to be discussed later. The tubing moves down a curved surface 28 and between a fixed engageable member or jaw 30 and a movable engageable member or jaw 32. The face of the stationary jaw 30 is adjacent the path of the tubing 18 with the jaw 32 movable toward and away from the path. Of course, both jaws can be moved between positions adjacent the path and spaced positions, if desired.

Figure 2:
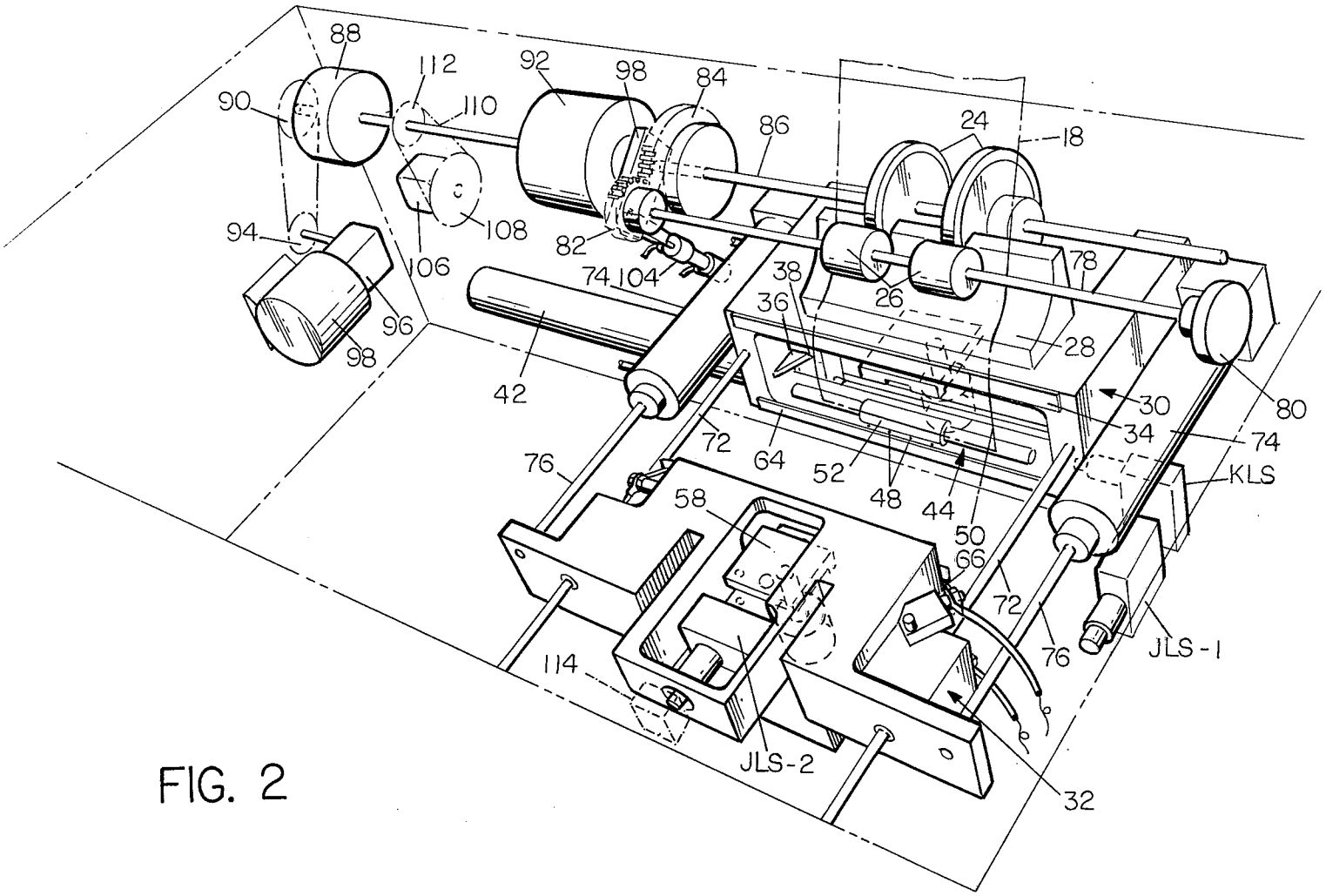
FIG. 2 is an enlarged, fragmentary view in perspective of the single-station of the packaging machine.
Figure 3:
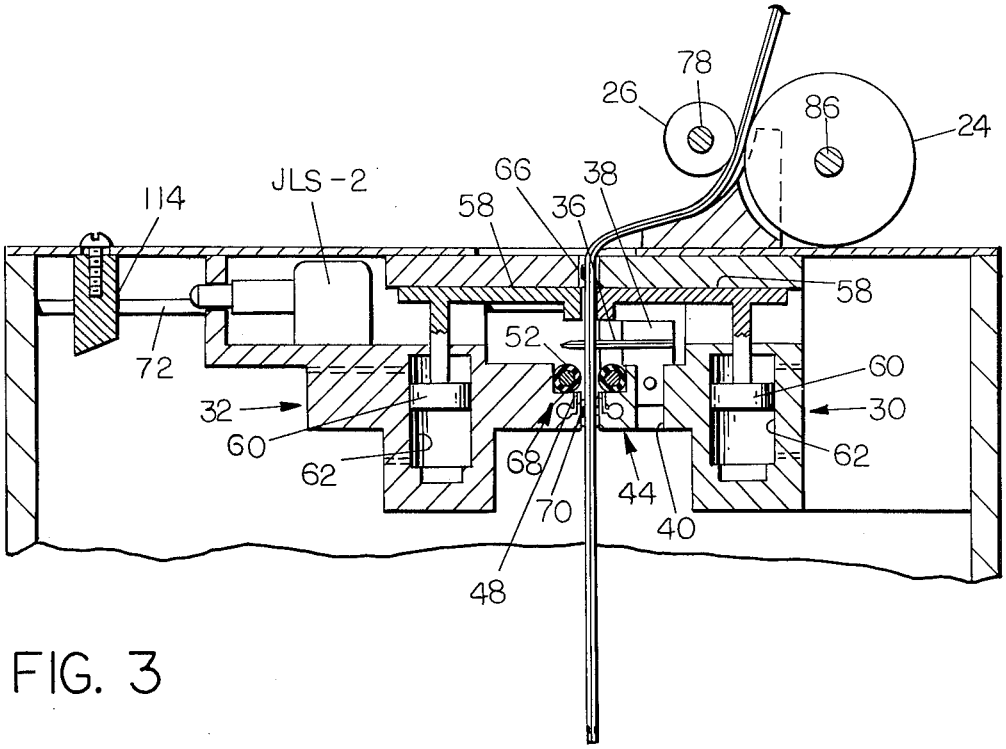
FIGS. 3 and 4 are schematic views in transverse cross section showing some sequential steps in the operation of the packaging machine.
Figure 4:
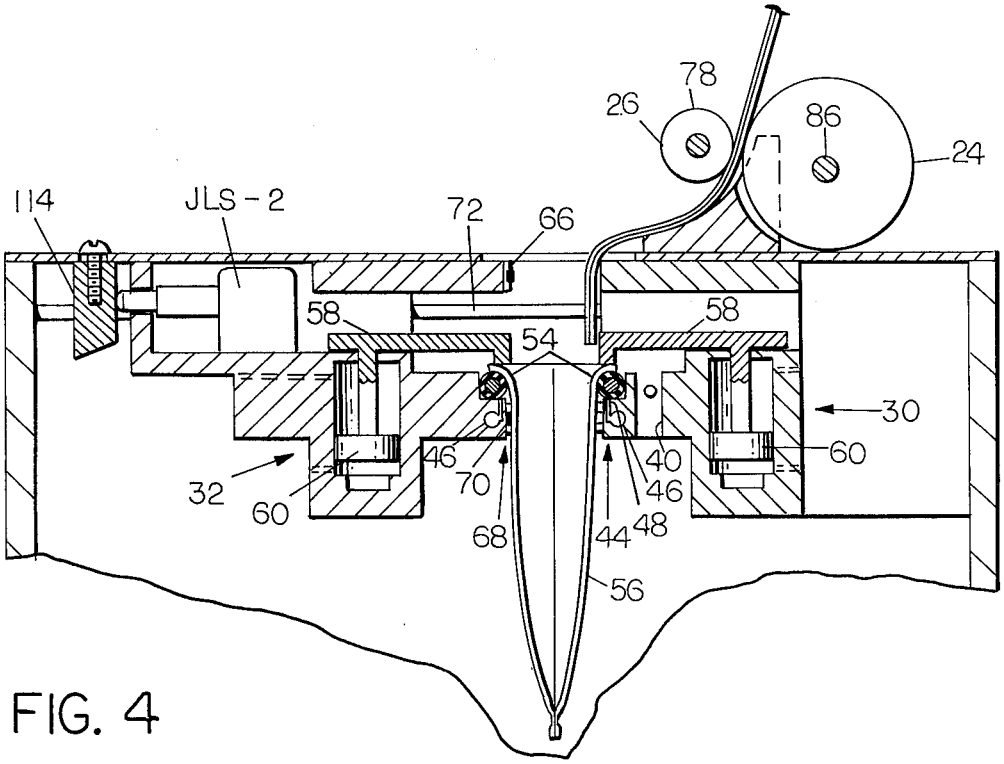

The stationary jaw 30 has an upper backup strip 34, below which is a knife blade 36 held in a supporting and guide block 38. As shown in FIGS. 3 and 4, the guide block is guided for movement transverse to the path of the tubing by a slot 40 in the jaw 30 and is driven by a fluid-operated cylinder 42 (FIG. 2). The stroke of the knife blade 36 exceeds the width of the widest tubing 18 used in the machine and the blade is sufficiently long to extend into a recess of the movable jaw 32 in order to sever the tubing.

The stationary jaw 30 has clamping means indicated at 44 located just below the knife blade 36. The clamping means includes an air manifold 46 (FIGS. 3 and 4) located in the stationary jaw and having a plurality of upper orifices 48. These orifices direct air from the manifold around a curved surface formed by a rod 50 and a resilient, central sleeve 52. When streams of air are directed upwardly around the curved surface, they establish a low pressure area which moves upper severed edges 54 (FIG. 4) of a lower severed package section 56 around the curved surface. A clamping bar 58 then moves down to clamp the severed edge against the resilient sleeve 52. The clamping bar 58 is connected to a piston 60 in a cylinder 62 which is formed internally in the stationary jaw 30. Similar clamping members are shown, described, and claimed in my U.S. Pat. No. 4,094,125.

Below the clamping means 44, the stationary jaw 30 has a lower backup sealing strip 64 which is similar to the strip 34, extending transversely of the tubing 18 a distance sufficient to exceed the widest tubing employed.

Referring now to the movable jaw 32, an upper sealing wire 66 is electrically heated and is effective to form a sealed strip across the tubing near the leading edge thereof when heated and moved toward the backup strip 34 to clamp the tubing 18 therebetween. Below the sealing strip and below the path of the knife blade 36, the movable jaw 32 also has clamping means 68 across from the clamping means 44. The clamping means 68 has substantially the same components as the clamping means 44 with these components acting in the same manner. Hence, the clamping means 68 will not be described further. When both of the clamping means engage both of the upper severed edges 54 of the section 56, they open these edges when the movable jaw 32 is moved away from the stationary jaw 30, as shown in FIG. 4. An article to be packaged can then be dropped by hand or by suitable loading means into the pocket formed by the opened section.

Below the clamping means 68, the movable jaw 32 has another sealing wire 70 which also is effective to form a sealed strip across the tubing when moved toward the backup strip 64 to clamp the tubing therebetween. Specifically, this sealed strip is formed near the upper severed edges 54 of the section 56 after the article is deposited therein. For moving the movable jaw 32, it is mounted on two guide rods 72 and is moved by two fluid-operated cylinders 74 having piston rods 76.

The drive for the rolls 24 and 26 will now be discussed. The backup rolls 26 are mounted on a shaft 78 which can be manually rotated by a knob 80 (FIG. 2) to manually advance the tubing 18. However, during normal operation, the shaft 78 is rotated by a driven spur gear 82 which meshes with a drive spur 84 affixed to a shaft 86 for the rolls 24. At the one end of the shaft 86, an electric magnetic clutch 88 is affixed thereto and a driven sprocket 90 is rotatably mounted thereon. The sprocket 90 is driven through a chain 92 by a drive sprocket 94 which is driven through a gear box 96 by a motor 98. When the electric magnetic clutch 88 is energized, it causes the sprocket 90 to rotate therewith and to drive the shaft 86 along with the spur gears 82 and 84.

Figure 5:
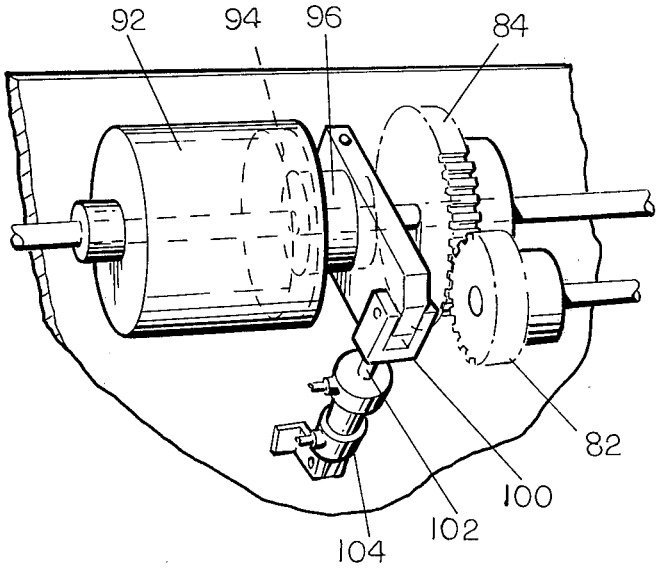
FIG. 5 is a view in perspective of a portion of the tubing drive of the machine.

An electric magnetic brake 92 is also affixed to the shaft 86. When its field is energized, it causes an armature plate 94 (FIG. 5), which is rotatably mounted on the shaft, to rotate therewith. However, the plate 94 is affixed by a hub 96, also rotatable on the shaft 86, to an arm 98 and the arm 98 is connected by a clevis 100 to a piston rod 102 extending from a fluid-operated cylinder 104, which is affixed to the machine. Consequently, when the electric magnetic brake 92 is energized, the shaft 86 abruptly stops because the arm 98, the hub 96, and the plate 94 cannot rotate due to the connection with the fluid-operated cylinder 104. This causes the drive rolls 24 and 26 to stop abruptly and to accurately determine the extent to which the tubing 18 is advanced between the jaws 30 and 32.

To determine the extent of the advance of the tubing, an adjustable, commercially-available counter 106 (FIG. 2) is provided. This is operated through a driven sprocket 108, a chain 110, and a drive sprocket 112 affixed to the shaft 86. When the counter reaches a preset condition, it de-energizes the electric magnetic clutch 88 to disconnect the sprocket 90 from the shaft 86 and energizes the brake 92 to magnetically connect the armature plate 94 to its field and cause the shaft 86 to stop abruptly. The drive components remain in this condition until the tubing 18 is to be advanced again. When this occurs, the fluid-operated cylinder 104 is momentarily energized to extend the piston rod 102 and caused the arm 98 to move up. This causes the rolls 24 and 26 to back up slightly, about three-sixteenths of an inch. The purpose of this slight retraction is to separate the leading edge of the tubing 18 from the backup strip 34 on the sealing wire 66 in the event it has a tendency to adhere after the sealing operation. This problem does not occur with the backup strip 64 and the sealing wire 70 because the weight of the article in the lower severed section 56 enables it to separate easily from those sealing components. Immediately after the cylinder 104 is energized, the electric magnetic brake is de-energized and the clutch 88 is energized to advance the tubing again until the counter 102 reaches its preset value.

The operation of the jaws 30 and 32 will now be described. With the jaw 32 open, as shown in FIG. 2, and with the leading edge of the tubing 18 having a transverse sealed strip formed during the previous cycle, the tubing is then advanced a predetermined distance to the position of FIG. 3. The counter 106 then de-energizes the clutch 88 and energizes the brake 92 and also causes the fluid to be supplied to the rod ends of the fluid-operated cylinder 74 to cause the movable jaw 32 to close. The movable jaw closes a first jaw limit switch JLS-1 which causes three functions to occur: Power is supplied to the upper sealing wire 66 to seal the leading edge of the tubing 18 thereabove. Air is supplied to the manifolds 46 to cause air to flow through the orifices 48 around the sleeves 52. Fluid under pressure is also supplied to the blind end of the cylinder 42 to cause the knife blade 36 and block 38 to travel across the jaw 30 to the other side and thereby form the upper severed edges 54 of what is now the lower package section 56. A timer is also energized and begins to time out. When the knife 36 reaches the other side, the block 38 closes a knife limit switch designated KLS which is in series with the timer. This switch causes fluid to be supplied to the rod ends of the cylinders 60 to cause the clamps 58 to clamp the newly-severed edges 54 against the sleeves 52. With the switch KLS closed, when the timer has timed out, fluid is supplied to the blind ends of the cylinders 74 to cause the jaw 32 to open. The timer assures that the jaws are closed long enough for the sealed strip at the leading edge of the tubing to be properly formed.

When the jaw 32 opens, an adjustable block 114 mounted on the machine actuates a second jaw limit switch JLS-2 mounted on the jaw 32. This causes fluid to be supplied to the rod ends of the cylinders 74 to close the jaw 32 once again. However, before the jaw closes, an article has been dropped into the pocket formed by the open section 56, the section being shown open in FIG. 4. When the jaw 32 moves in the second time, the lower sealing wire 70 is supplied with power to form a sealed strip across the upper edge of the section 56, just below the severed edges 54. The limit switch JLS-2 also initiated a timer so that the jaws stay closed to assure formation of the sealed strip at the upper edge of the severed section until the timer times out. At that time, the jaw 32 opens once again and fluid is supplied to the blind ends of the cylinders 60 to raise the clamps 58, releasing the now-filled and formed package which drops downwardly and is discharged from the station. As the clamps open, fluid is also supplied to the rod end of the cylinder 42 to reset the knife blade 36 to its original position and air to the manifolds 46 is shut off. The tubing above with the sealed leading edge is then slightly retracted and advanced again to initiate another cycle.

It will thus be seen that the new machine has comparatively few moving parts and fewer total parts which substantially reduces the cost thereof and maintenance. Further, while two motions of the jaw are required to complete one package, nevertheless, the production rate of the machine is high and comparable with that of two-station machines.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. A machine for making packages sequentially from a length of plain flexible tubing, said machine comprising means for advancing the tubing lengthwise along a path and for stopping the advance, first sealing means along the path for forming a transverse sealed strip across the tubing, means along the path beyond said sealing means for severing the tubing near the sealed strip and forming a severed section, means along the path beyond said sealing means and beyond said severing means for holding the severed edges of the severed section to open and close the severed section, second sealing means along said path beyond said holding means for forming a second transverse sealed strip near the severed edges, and means for retracting the tubing slightly before advancing it.

2. A machine for making packages sequentially from a length of flexible tubing, said machine comprising at least two rolls for engaging sides of the tubing, means for rotating said rolls for advancing the tubing along a path a predetermined distance and for stopping the rotation, sealing means spaced downstream of said rolls for forming first sealed strips across the tubing, means downstream of said sealing means for severing the tubing, means downstream of said severing means for clamping severed edges of the tubing and for opening and closing the severed section, means downstream of said clamping means for forming second sealed strips across the tubing near the severed edges thereof, and means for reversing said rolls slightly to retract the tubing before advancing it.

3. A machine for making packages sequentially from a length of flexible tubing, said machine comprising a first jaw and a second jaw, means for moving at least one of said jaws toward and away from the other of said jaws, means for advancing the tubing lengthwise between said jaws with the tubing having a first sealed strip extending transversely across a leading edge thereof, said jaws having first heat sealing means at upper portions thereof for forming a sealed strip across the tubing, at least one of said jaws having severing means located below the first heat sealing means, both of said jaws having gripping means below said severing means for clamping severed edges of the severed section to open the section when said jaws are separated, and said jaws having second heat sealing means below said gripping means.

4. A machine according to claim 3 characterized by said machine having means for energizing said first heat sealing means when the jaws are brought together a first time, and means for energizing the second heat sealing means when the jaws are then brought together a second time.

5. A machine according to claim 3 characterized by means for retracting the tubing slightly before advancing it.

* * * * *